United States Patent [19]

Norton et al.

[11] Patent Number: 4,489,996

[45] Date of Patent: Dec. 25, 1984

[54] CABINET WITH AN EXTERNAL SHELF AND CUP DISPENSER

[75] Inventors: Terry L. Norton, Royston; Neil V. Constantine, Hartwell, both of Ga.

[73] Assignee: Royston Manufacturing Corporation, Royston, Ga.

[21] Appl. No.: 410,561

[22] Filed: Aug. 23, 1982

[51] Int. Cl.[3] ..... A47F 3/02

[52] U.S. Cl. ..... 312/279; 312/42; 312/140.4; 312/257 M; 312/281

[58] Field of Search ..... 312/140.4, 240, 293, 312/257 M, 257 R, 257 K, 257 A, 138, 279, 42, 281; 221/279

[56] References Cited

U.S. PATENT DOCUMENTS

| | | | |
|---|---|---|---|
| 2,220,503 | 11/1940 | Whelan | 312/279 |
| 2,238,193 | 4/1941 | Stephens | 312/279 |
| 2,261,880 | 11/1941 | Hope | 221/279 |
| 2,632,434 | 3/1953 | Pearce | 312/257 R |
| 2,732,273 | 1/1956 | Schaffner | 312/257 SK |
| 2,912,294 | 11/1959 | Wells et al. | 312/257 R |
| 3,371,977 | 3/1968 | McCabe | 312/257 R |
| 3,410,622 | 11/1968 | Stewart | 312/257 R |
| 4,002,383 | 1/1977 | Holloway, Jr. | 312/257 SK |
| 4,264,113 | 4/1981 | Suttles | 312/140.3 |
| 4,319,793 | 3/1982 | Suttles | 312/108 |

*Primary Examiner*—Francis K. Zugel
*Assistant Examiner*—Thomas A. Rendos
*Attorney, Agent, or Firm*—Howson & Howson

[57] ABSTRACT

In a sheet metal cabinet designed for convenience store use, an L-shaped recessed shelf provides a space for horizontally extending cup dispensers which extend underneath the cabinet and present cups at locations immediately above the recessed shelf. The L-shaped recessed shelf is part of a specialized cabinet front structure which also includes a framework having access doors located underneath the front edge of the recessed shelf. This framework has a U-shaped horizontal cross section, with side panels extending downwardly from the side edges of the shelf and meeting the side panels of the main part of the cabinet.

1 Claim, 5 Drawing Figures

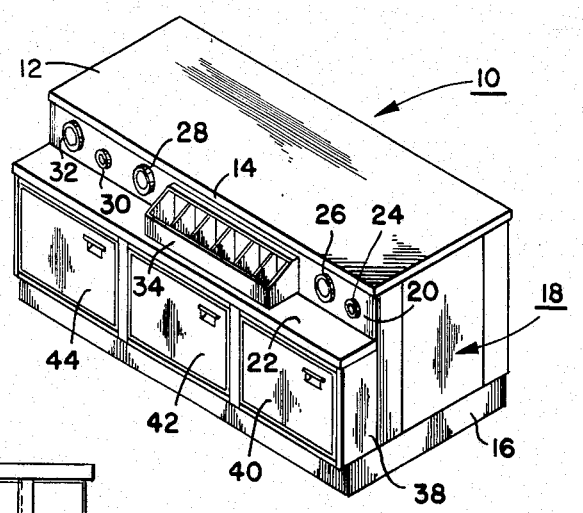
FIG. 1.
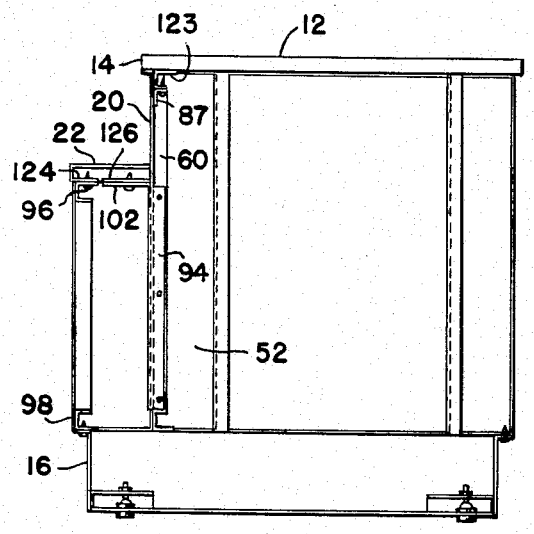
FIG. 3.
FIG. 4.
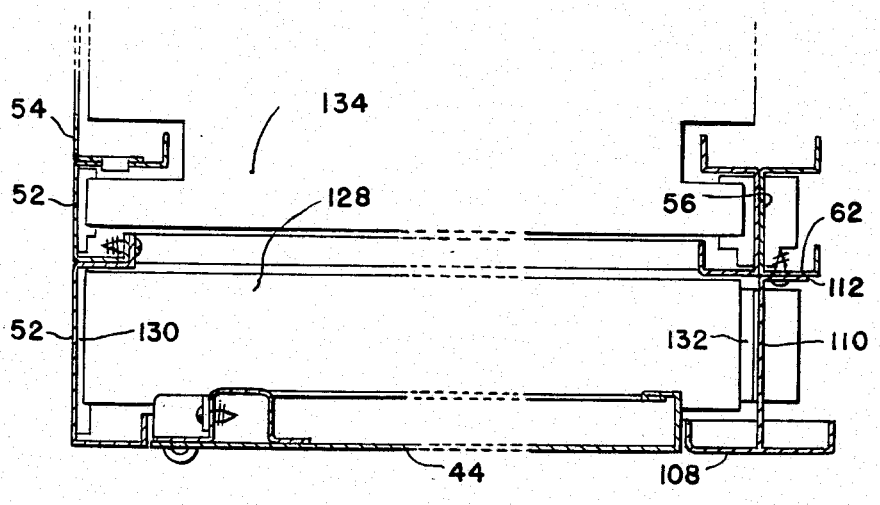

CABINET WITH AN EXTERNAL SHELF AND CUP DISPENSER

BRIEF SUMMARY OF THE INVENTION

This invention relates to cabinets and has particular utility in cabinets of the type used both for storage and as food service counters in convenience stores.

Convenience store cabinets of the type to which this invention relates are described in U.S. Pat. No. 4,264,113, dated Apr. 28, 1981 and U.S. Pat. No. 4,319,793, dated Mar. 16, 1982. The disclosures of both of said patents are incorporated herein by reference for the purpose of disclosure of structural details. While the patents show a cabinet having a square counter top, obviously the principles of construction are applicable to elongated cabinets having oblong counter tops of any desired length.

When a cabinet is used for food service in a convenience store, its counter top is typically used to support various articles, including displays, coffee makers, microwave ovens, trays for holding condiments (such as packaged mustard, ketchup, etc.), straws, stirrers, sugar packets and the like, and cup dispensers. These various articles take up a great deal of counter space which could be used for better purposes if made available.

The principal object of this invention is to provide a combined storage cabinet and counter which uses available space much more efficiently than was heretofore possible. The invention recognizes that the entire vertical height of a cabinet's interior storage space is not normally utilized for storage purposes, and that cup dispensers can be installed underneath the counter top in a practical manner by providing a recessed shelf located above vertically shorter cabinet access doors. The recessed shelf protects the cups presented by the cup dispensers from being damaged by persons walking past the counter or leaning against it. The shelf also provides a convenient location for condiment trays and possibly other articles. Positioning the cup dispensers underneath the counter top and positioning the condiment trays on the recessed shelf makes a substantial area of the counter top available for other purposes.

Another object of the invention is to provide a simple and inexpensive front structure which can be used to modify existing cabinets, including cabinets of the type described in the aforementioned patents. It is also an object of the invention to simplify cabinet manufacture by making it possible to use a standard cabinet either with or without the special front structure providing for a recessed shelf.

The cabinet in accordance with the invention comprises a top having a front edge, two structural members extending downwardly from the top and having front edges, and is characterized by a special cabinet front assembly comprising a first panel, a shelf, and means for closing the front of the lower part of the cabinet below the shelf. The first panel extends downwardly from the top of the cabinet, and has opposite vertical edges meeting upper portions of the respective front edges of the structural members. The first panel has a lower edge, and the shelf extends forwardly from the lower edge of the first panel. The shelf has opposite side edges which meet the respective first edges of the structural member perpendicularly. The means for enclosing the front of the lower part of the cabinet below the shelf comprises a frame having generally U-shaped horizontal cross sections with side panels and a front. The side panels of the U-shaped frame extend downwardly from the opposite side edges of the shelf, and forwardly from the front edges of the two structural members. The front of the enclosing means comprises operable means (typically one or more doors) for providing access to the interior of the cabinet.

BRIEF DESCRIPTION OF THE DRAWINGS

FIG. 1 is an oblique perspective view of a cabinet in accordance with the invention showing the special front assembly having a recessed shelf, a condiment tray located on the shelf, and cup dispensers located below the counter top of the cabinet;

FIG. 3 is a vertical section illustrating the manner in which the front assembly is secured to the vertically extending structural members of the cabinet;

FIG. 4 is a horizontal section illustrating further details of the special front assembly, and the manner in which it is secured to the remainder of the cabinet.

DETAILED DESCRIPTION

Figure 2:
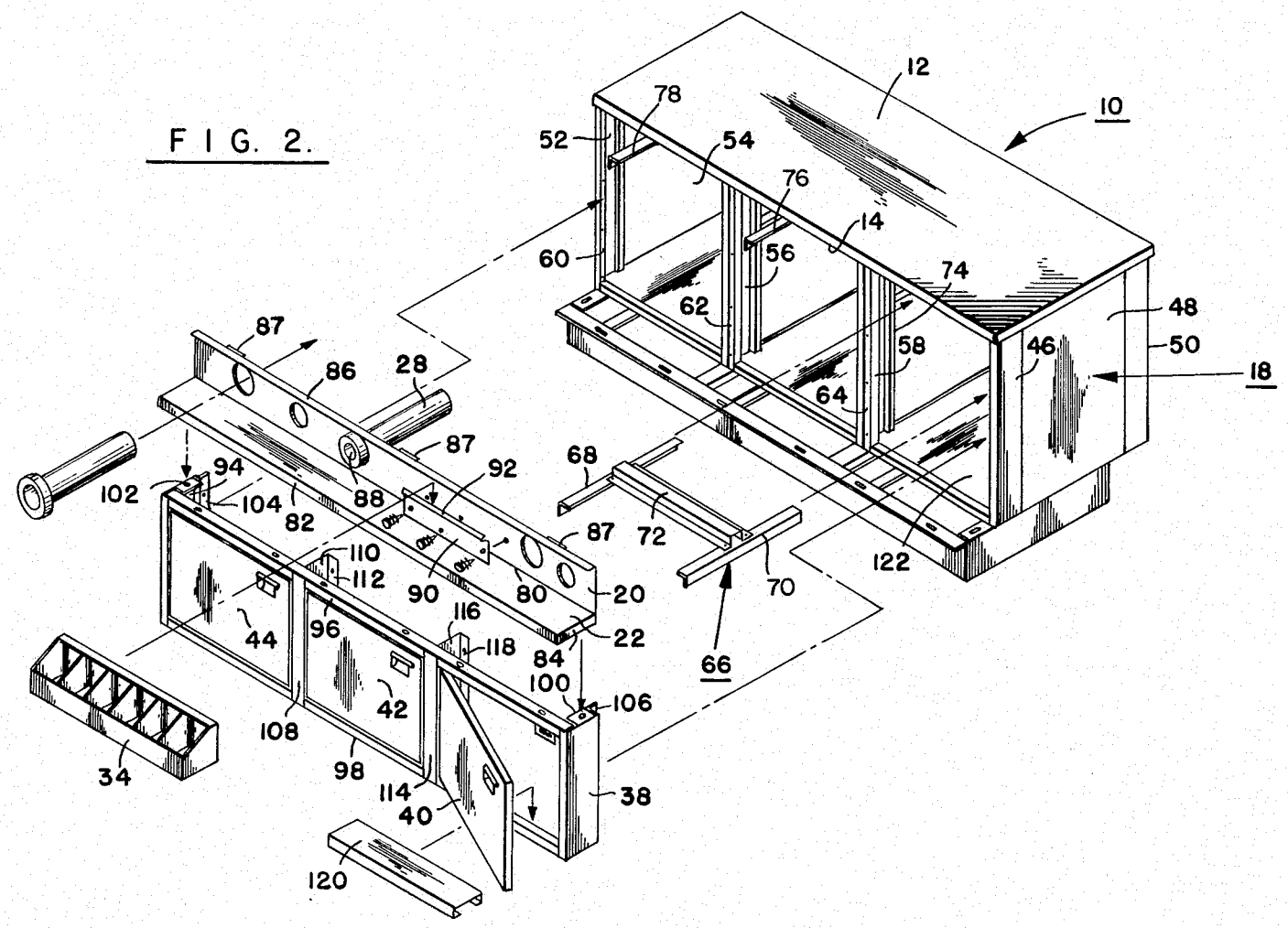
FIG. 2 is an exploded view, in perspective, showing the principal elements of the cabinet.

In FIG. 1, cabinet 10 comprises a counter top 12, which is typically of stainless steel. The counter top is of oblong shape, and has a front edge 14. The cabinet base 16 rests on the floor, and extending from the base to the underside of top 12 are side wall 18 and an opposite side wall and a rear wall, not shown in FIG. 1.

A panel 20 extends downwardly from the approximate location of front edge 14 of the top to an intermediate location between the top and the base. At this intermediate location, a shelf 22 extends forwardly from the lower edge of panel 20. Preferably though not necessarily, panel 20 and shelf 22 extend the full width of the cabinet. On panel 20 are mounted a series of cup dispensers 24, 26, 28, 30 and 32. The supply tubes of these cup dispensers extend horizontally underneath top 12, and the dispensers present cups (not shown) for removal at the dispenser openings above shelf 22.

On the shelf, between dispensers 26 and 28 is a condiment tray 34 having partitions for separating such articles as ketchup packets, mustard packets, sugar packets, etc. The compartments in tray 34 can also be used for holding plastic coffee stirrers, and disposable eating utensils.

Below shelf 22 is a closure assembly comprising a framework having a side panel 38 and an opposite side panel (not shown) and doors 40, 42 and 44. These doors provide access to the storage space within the cabinet.

Referring to FIG. 2, the basic cabinet 10, being of the type disclosed in U.S. Pat. Nos. 4,264,113 and 4,319,793, has two side walls, each comprising three distinct side wall panels. Thus, side wall 18 comprises panels 46, 48 and 50. Panel 46 and its counterpart 52 at the opposite side of the cabinet are parts of a U-shaped cabinet front structure which is secured to the intermediate side panels 48 and 54 of the cabinet by the cooperation of interlocking slots and tabs. Side panel 50 and its counterpart at the opposite end of the cabinet are similarly secured to intermediate side panels 48 and 54 respectively.

Side panels 46 and 52 extend downwardly from the top to the base and serve as structural members of the cabinet. In the particular cabinet shown, these members extend vertically downwardly from the approximate location of front edge 14 of the top. Intermediate structural members are provided at 56 and 58.

Side panel 52 has a return flange 60 with a series of screw holes for use in attaching the special front assembly of the cabinet. Side panel 46 has a similar return flange (not seen in FIG. 2). Member 56 has a forwardly facing flange 62 with a series of screw holes, and member 58 has a similar forwardly facing flange 64.

An H-shaped dispenser support is shown in FIG. 2 at 66. The dispenser support comprises a pair of parallel L-shaped members 68 and 70 connected by a channel 72, which serves as a rest for the supply tubes of one or more cup dispensers. L-shaped members 68 and 70 are secured by rivets to flanges on the vertically extending structural members of the cabinet, one such flange being indicated at 74. These flanges are at intermediate locations between the front and rear faces of the cabinet, and their locations and configurations are explained in greater detail in U.S. Pat. Nos. 4,264,113 and 4,319,793. These flanges are normally slotted and are used for supporting shelves within the cabinet. Although the dispenser supports shown are held in place by rivets, it is possible to provide them alternatively with tabs for engagement with slots in the shelf support flanges, thereby dispensing with the need for rivets or sheet metal screws. The remaining dispenser supports are visible in FIG. 2 at 76 and 78.

Again referring to FIG. 2, vertical panel 20 and shelf 22 are preferably a unitary structure of sheet stainless steel. The shelf meets panel 20 perpendicularly at fold 80, and is provided with a downward front flange 82 and downward side flanges at its narrow ends, one such side flange being indicated at 84. These downwardly extending flanges are provided, as indicated in FIG. 3, with inwardly extending return flanges. The upper end of panel 20 is desirably provided with a forwardly extending flange 86. Three rearwardly extending brackets are provided at 87 for attachment of vertical panel 20 to top 12, as shown in FIG. 2.

Panel 20 is provided with a series of openings for the cup dispensers. Cup dispenser 28 is shown in place on panel 20 with its supply tube extending rearwardly from panel 20, and its delivery opening 88 being located just in front of panel 20 above shelf 22. The width of shelf 22 is such that cups projecting from the cup dispensers do not extend beyond the front edge of the shelf.

A clip 90 is secured to panel 20. This clip has an upwardly extending flange 92 which engages a flange (not shown) on the rear of condiment tray 34 to hold the tray in place on shelf 22 and at the same time provide for easy removal of the tray when necessary for cleaning or replacement.

The enclosure for the lower part of the cabinet comprises side panels 38 and 94, and horizontal frame members 96 and 98 respectively above and below the doors. The closure has a generally U-shaped cross section, panels 38 and 94 constituting the parallel parts of the U. The upper end of panel 38 has an inwardly turned flange 100, and the upper end of panel 94 has a similar inwardly turned flange 102. These inwardly turned flanges are provided with holes for sheet metal screws which attach the closure assembly to the underside of shelf 22. A flange 104 on panel 94 engages flange 60 of side wall panel 52 of the cabinet, and these two flanges are secured together by sheet metal screws. A flange 106 on panel 38 is similarly secured to a flange on side wall panel 46 at the opposite end of the cabinet. Between doors 42 and 44 is a vertically extending panel 108, which has a rearwardly extending member 110 having a flange 112. Flange 112 is secured by sheet metal screws to flange 62 on vertically extending structural member 56. Similarly, between doors 40 and 42 is a panel 114 having a rearwardly extending member 116 with a flange 118 for attachment to flange 64 of structural member 58.

A panel 120 is positioned directly behind horizontal member 98 of the closure assembly, and serves, along with panel 122 within the main cabinet, as a floor. Similar panels (not shown) are provided behind doors 42 and 44.

FIG. 3 shows further details of the manner in which the front structure is attached to the main body of the cabinet. A bracket 87 is shown secured by a sheet metal screw to channel 123 which extends along the underside of stainless steel top 12. The attachment of brackets 87 to channel 123 provides firm support for panel 20.

FIG. 3 also shows how flange 96 is secured by sheet metal screws to a return flange 124 on the underside of shelf 22. A return flange 126 on the underside of shelf 22 is also secured to flange 102 of the front structure by a sheet metal screw.

Finally, FIG. 3 shows the attachment of flange 94 of the front structure to flange 60 of panel 52, and the manner in which base 16, with adjustable feet, is secured to the underside of the cabinet structure.

FIG. 4 shows a floor member 128 (corresponding to member 120 in FIG. 2) resting, at one end on flange 130 at the lower end of side panel 52, and at its other end on flange 132, which is part of an L-shaped element spot welded to member 110, which is also seen in FIG. 2.

Floor member 128 is flush with main cabinet floor member 134, and serves as an extension thereof. Although shelves can be used in this form of cabinet, normally, they will not be used. Rather, all of the articles within the cabinet will be placed on the floor of the cabinet.

Figure 5:
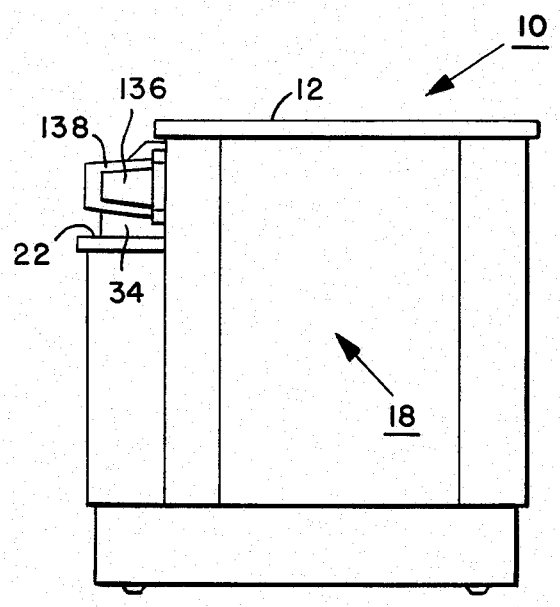
FIG. 5 is a side elevation of the cabinet, showing cups projecting from the cup dispensers over the recessed shelf.

The cabinet described above accommodates cup dispensers and a condiment tray, while providing a clear counter top which can be used for various other purposes. As shown in FIG. 5, cups of various sizes, including small cup 136 and large cup 138, are presented for removal. Shelf 22 extends a short distance forward of the largest of these cups. The cups presented for removal from the cup dispensers are protected by shelf 22, and shelf 22 can be used not only for supporting the condiment tray, but also as an additional work surface. The cabinet provides the foregoing advantages without seriously interfering with usable internal storage space.

Numerous modifications can be made to the cabinet described. It is possible to provide the modified front structure as shown in FIG. 1 on both sides of the cabinet, and this can be accomplished by making comparatively simple modifications to the basic cabinet structure. It is also possible to provide the cabinet in accordance with the invention in any desired length. Various further modifications can be made without departing from the invention as described in the following claims.

We claim:

1. A storage cabinet for use in self-service convenience stores and the like comprising a cabinet enclosure providing a storage space, the cabinet enclosure including a horizontal counter top above the storage space forming a top for the storage space, a front wall having an upper edge and openable means for providing access to the storage space, and at least one cup dispenser, each cup dispenser comprising a supply tube extending horizontally underneath the counter top in close proximity thereto, wherein each cup dispenser has a cup delivery opening spaced rearwardly with respect to the front wall of the cabinet, the counter top has a front edge also spaced rearwardly with respect to the front wall of the cabinet, and the front structure of the cabinet includes a panel extending vertically downwardly from the front edge of the counter top and terminating in a lower edge and a horizontal shelf extending forwardly from the lower edge of said panel to the upper edge of the front wall, the panel has an opening corresponding to each cup dispenser, each cup dispenser contains a supply of cups within its supply tube, the supply of cups in each cup dispenser extends through the corresponding opening in the panel, and the foremost cup in each dispenser projects forwardly from the cup delivery opening, the delivery opening of each cup dispenser being approximately at the location of the panel and the width of the shelf being such that the furthest forwardly projecting one of said cups extends almost to, but does not project beyond, the front edge of the shelf, whereby the cups are protected from being damaged by persons walking past or leaning against the cabinet.

* * * * *